US011795039B2

(12) United States Patent
Uderhardt

(10) Patent No.: US 11,795,039 B2
(45) Date of Patent: Oct. 24, 2023

(54) LOCKING DEVICE FOR A TELESCOPIC BOOM, TELESCOPIC BOOM, AND MOBILE CRANE

(71) Applicant: TADANO FAUN GMBH, Lauf a. d. Pegnitz (DE)

(72) Inventor: Detlef Uderhardt, Lauf an der Pegnitz (DE)

(73) Assignee: TADANO FAUN GmbH, Lauf a.d. Pegnitz (DE)

( * ) Notice: Subject to any disclaimer, the term of this patent is extended or adjusted under 35 U.S.C. 154(b) by 8 days.

(21) Appl. No.: 17/720,500

(22) Filed: Apr. 14, 2022

(65) Prior Publication Data

US 2022/0332551 A1 Oct. 20, 2022

(30) Foreign Application Priority Data

Apr. 14, 2021 (DE) ..... 10 2021 203 700.3

(51) Int. Cl.
*B66C 23/70* (2006.01)
*B66C 23/00* (2006.01)

(52) U.S. Cl.
CPC ..... *B66C 23/708* (2013.01); *B66C 23/54* (2013.01); *B66C 2700/0371* (2013.01)

(58) Field of Classification Search
CPC ..... B66C 23/708; B66C 23/54
See application file for complete search history.

(56) References Cited

U.S. PATENT DOCUMENTS 4,036,372 A * 7/1977 Rao ..... B66C 23/705 212/292
11,629,035 B2 * 4/2023 Zushi ..... B66C 13/46 212/292
2015/0041422 A1 * 2/2015 Kaupert ..... B66C 23/708 212/292

(Continued)

FOREIGN PATENT DOCUMENTS

CN 102730578 B * 6/2014 ..... B66C 23/708
DE 102011116083 B4 6/2013
EP 2835336 B1 2/2018

OTHER PUBLICATIONS

CN 102730578B Machine Translation. (Year: 2014).*

*Primary Examiner* — Michael R Mansen
*Assistant Examiner* — Juan J Campos, Jr.
(74) *Attorney, Agent, or Firm* — Laurence A. Greenberg; Werner H. Stemer; Ralph E. Locher

(57) ABSTRACT

A locking device for a telescopic boom, in particular of a mobile crane, has an actuator for generating an actuating force, a driver that is reversibly coupled, during a telescoping movement of the telescopic boom, to a locking bolt, which is secured at a boom extension segment of the telescopic boom, and to be moved under the action of the actuating force for adjusting the locking bolt between at least one locking position and a release position. A driver bolt can be moved reversibly by the actuating force between a carry-along position gripping an inner boom extension segment and an empty running position not gripping a boom extension segment. A slotted actuating link is configured for a joint movement of the locking bolt and the driver bolt. A movement plane of the slotted actuating link is oriented perpendicularly to the telescoping direction of the telescopic boom.

16 Claims, 5 Drawing Sheets

(56) References Cited

U.S. PATENT DOCUMENTS

| | | | | |
|---|---|---|---|---|
| 2015/0128735 | A1* | 5/2015 | Klein | F16H 21/44 74/110 |
| 2021/0039924 | A1* | 2/2021 | Zushi | B66C 23/705 |
| 2021/0039926 | A1* | 2/2021 | Zushi | B66C 13/46 |

* cited by examiner

LOCKING DEVICE FOR A TELESCOPIC BOOM, TELESCOPIC BOOM, AND MOBILE CRANE

CROSS-REFERENCE TO RELATED APPLICATION

This application claims the priority, under 35 U.S.C. § 119, of German Patent Application DE 10 2021 203 700.3, filed Apr. 14, 2021; the prior application is herewith incorporated by reference in its entirety.

FIELD AND BACKGROUND OF THE INVENTION

The invention relates to a locking device for a telescopic boom, in particular for a telescopic boom of a mobile crane. The invention furthermore relates to such a telescopic boom or jib. Furthermore, the invention relates to a mobile crane having such a telescopic boom.

A telescopic boom is conventionally a length-adjustable (mobile) crane assembly which is conventionally pivotable about a vertical axis and/or transverse axis and which is consequently generally used for lifting, in particular for moving loads. Telescopic booms of this type are customarily formed by a plurality of (i.e., at least two) boom segments or telescope tubes which are arranged displaceably one inside another. Said boom segments are locked to one another in their respective actuating positions with respect to one another, at least in an extended actuating position, generally also in a retracted actuating position, such that no actuating force for maintaining said actuating position is required. In order to lock the boom segments to one another, a "locking bolt" is customarily brought into engagement in a form-fitting manner with the two boom segments transversely with respect to the longitudinal extent of the two boom segments. The locking bolts are conventionally arranged displaceably on the inner of the two boom segments.

For the length adjustment of the boom segments with respect to one another, the telescopic boom generally comprises a hydraulic cylinder which is arranged in the interior of the two boom segments or of all of the boom segments. Said hydraulic cylinder is coupled in a form-fitting manner to the corresponding boom segment for telescoping same and, with a locking device arranged on the hydraulic cylinder, unlocks the locking bolt (or conventionally two locking bolts arranged on opposite longitudinal sides of the boom segment) such that the respective boom segment can be displaced in relation to the surrounding boom segment. Subsequently, the hydraulic cylinder moves in the longitudinal direction and, as it does so, carries along the boom segment to be displaced.

For the form-fitting coupling to the respective boom segment, the hydraulic cylinder conventionally has driver bolts which are displaceable in the transverse direction and which are located in corresponding receptacles of the respective boom segment during the telescoping operation. Expediently, the driver bolts are arranged here in a region (portion) of the hydraulic cylinder at which the locking device for locking and unlocking the locking bolts is also arranged. This region of the hydraulic cylinder is also referred to as a "locking head".

The driver bolts and the locking device are conventionally actuated hydraulically. The locking device has drivers which are generally arranged displaceably in the transverse direction with respect to the hydraulic cylinder and which, in a coupling position of the hydraulic cylinder as intended with respect to the boom segment to be telescoped, are in engagement with the respective locking bolt and are therefore coupled in terms of force transmission. The locking head of the hydraulic cylinder therefore has to have an actuator, in particular an hydraulic actuating device for the driver bolts and for the drivers for locking and unlocking the locking bolts.

SUMMARY OF THE INVENTION

The invention is based on the object of improving the locking and unlocking of boom segments of a telescopic boom.

With the above and other objects in view there is provided, in accordance with the invention, a locking device for a telescopic boom, the locking device comprising:

an actuator for generating an actuating force;

a locking bolt secured at a boom extension segment of the telescopic boom;

at least one driver configured to be reversibly coupled, during a telescoping movement of the telescopic boom, to said locking bolt, and to be moved by the actuating force for adjusting said locking bolt between a locking position and a release position;

at least one driver bolt configured to be reversibly moved by the actuating force between a carry-along position, gripping an inner boom extension segment, and an empty running position in which no boom extension segment is gripped; and a slotted actuating link configured for a joint movement of said locking bolt and said at least one driver bolt, said slotted actuating link, in an installation state as intended, defining a movement plane perpendicular to a telescoping direction of the telescopic boom.

In other words, the locking device according to the invention is configured and provided for use in or on a telescopic boom, in particular of a mobile crane. Such a telescopic boom conventionally has a plurality of boom segments which are mounted displaceably (telescopically) within one another. The outermost, non-displaceable boom segment is also referred to here as "main segment," and the inner boom segment(s) in each case as a "boom extension segment."

The locking device here has an actuator for generating an actuating force. Furthermore, the locking device has at least one driver which is configured, in the use state as intended, to be reversibly coupled, during a telescoping movement of the telescopic boom, to an associated locking bolt, which is secured at a boom extension segment (or: "boom segment") of the telescopic boom. In addition, the driver is configured to be moved under the action of the actuating force for adjusting the locking bolt between a locking position and a release position. The locking device furthermore has at least one driver bolt which is configured to be moved reversibly under the action of the actuating force between a carry-along position gripping an inner boom extension segment and an empty running position not gripping a boom extension segment. In addition, the locking device has a slotted actuating link which is configured (preferably by its own movement driven by the actuating force) for the joint movement of the locking bolt and of the driver bolt (in particular by transmitting the actuating force to them), wherein, in the installation state as intended, a, preferably the single, movement plane of the slotted actuating link is oriented perpendicularly to the telescoping direction, in particular defined radially with respect thereto.

The movement direction of the driver and/or of the driver bolt preferably lies in the movement plane of the slotted actuating link, but is oriented perpendicularly to the movement axis thereof (and here also perpendicularly to the telescoping direction).

Owing to the fact that the slotted actuating link is oriented with its movement plane perpendicularly to the telescoping direction, the activation, in particular the transmission of movement to the driver and to the driver bolt, is simplified by using just one element, namely the slotted actuating link.

In a preferred embodiment, the slotted actuating link is designed as a plate in which a first slotted link groove is incorporated for the driver and a second slotted link groove is incorporated for the driver bolt. In said slotted link grooves, the driver and the driver bolt are in each case coupled in terms of force transmission. In particular, the driver and also the driver bolt are in each case assigned a guide element which is coupled rigidly to the driver and to the driver bolt and is located in the corresponding slotted link groove. The guide element is preferably designed in the form of a rod, referred to below as "slotted link rod". The slotted actuating link is consequently formed by an element, namely the plate, in which a respective slotted link groove for the respective component to be actuated, i.e., the driver and the driver bolt, is integrated. The transmission of the actuating force to the driver and to the driver bolt is thereby simplified because of the reduction in the number of required components and the amount of construction space required can be reduced.

In an expedient embodiment, the slotted actuating link is designed in such a manner that the driver bolt is arranged in its empty running position when the driver is arranged in the position assigned to the locking position of the locking bolt (and correspondingly vice versa). For better understanding and for simplification purposes, this position of the driver is likewise referred to as locking position, and the other position correspondingly as release position. Consequently, the driver and the driver bolt are adjusted in a diametrically opposed manner by the slotted actuating link.

The locking device preferably in each case has a pair of drivers and driver bolts. The drivers and driver bolts are expediently arranged diametrically opposite one another in order, with their respective engagement in the boom extension segments, to permit a stable, symmetrical connection to the respectively assigned other boom extension segment or to a telescopic drive, in particular to a hydraulic telescopic cylinder. The respective drivers and driver bolts are moved here preferably in opposite directions by means of the slotted actuating link during their respective adjustment. For example, the drivers are both moved outward or both moved inward, preferably along the same movement axis.

In an expedient development of the above-described slotted actuating link which is formed by a plate and adjusts the driver and the driver bolt in a diametrically opposed manner, the first and the second slotted link groove each have at least two curved portions. Said curved portions are preferably formed substantially rectilinearly—i.e., in particular exactly or in the range of customary tolerances, in particular except for transitions between the curved portions. A curved portion that is referred to as "retraction portion" of said curved portions is positioned here at an angle counter to a push-out direction (in particular the associated movement axis) of the locking bolt (and therefore of the driver) or of the driver bolt. In particular, one end of the retraction portion is "free", i.e., does not merge into another curved portion. This free end is expediently offset inward counter to the push-out direction. The retraction portion therefore thus serves for retracting the driver or the driver bolt counter to the push-out direction. A "securing portion" of the curved portions is arranged in each case in the push-out direction of the locking bolt or of the driver bolt on the outer side with respect to the retraction portion (i.e., in particular offset with respect to an outer side of the slotted actuating link) and is preferably oriented perpendicularly to the push-out direction (or to the movement axis). If in particular the above-described slotted link rod of the driver or of the driver bolt moves along the securing portion, the driver bolt or the driver is in its carry-along position or in the locking position (i.e., is already "locked").

The above-described securing portions preferably each face here in opposite directions, but in particular parallel to the movement direction of the slotted actuating link. Therefore, the respective inside ends of the securing portions for the driver and the driver bolt, which inside ends are assigned to the same longitudinal side of the telescopic boom, face one another and the free ends face away from one another. The same consequently also applies to the retraction portions. The above-described opposed movement of the respective bolts during the movement of the slotted actuating link is thereby realized.

In a further expedient embodiment, the slotted actuating link has a neutral position. Preferably, in this neutral position, the locking bolt is arranged in its locking position because of an actuating spring assigned thereto, at least when the boom extension segments to be coupled to one another are arranged in a coupling position as intended with respect to one another. The driver bolt is preferably also arranged in its carry-along position. Furthermore, optionally in this neutral position of the slotted actuating link, the driver, however, can also be arranged in a neutral position arranged between the locking position and the release position, in particular when the boom extension segments to be coupled to one another are not arranged in an intended coupling position with respect to one another.

The slotted actuating link is preferably spring-loaded directly or indirectly in the direction of its neutral position. This therefore permits a "safety position", if drive energy ceases during the telescoping operation. In this case, the locking bolt would therefore remain in its locking position, but the driver bolt would likewise be in engagement with the corresponding boom extension segment—at least if the locking device is at the appropriate location at the time that energy ceases. A secured state of the telescopic boom is therefore provided if the drive energy ceases.

In a particularly expedient embodiment, the slotted actuating link, in particular the first slotted link groove, is designed in such a manner that, in the neutral position of the slotted actuating link, a restoring force applied externally to the driver, in particular to the associated locking bolt, in particular by crane staff, can lead to an adjustment of the driver—at least when drive energy is missing. As a result, emergency unlocking of the corresponding boom extension segment is provided, for example in order to permit manual telescoping inward of the telescopic boom when the drive energy ceases.

In order, for example, inter alia to simplify the above-described emergency unlocking, in a preferred embodiment, the first slotted link groove has a third curved portion. The latter lies between the retraction portion and the securing portion, and is assigned to the neutral position of the slotted actuating link. In other words, the slotted link rod of the driver is located in said third curved portion when the slotted actuating link is arranged in the neutral position. In comparison to the retraction portion, the third curved portion is also positioned more shallowly counter to the push-out direction (or the movement axis), i.e., is in particular inclined less strongly away from the push-out direction. As a result, during a manual displacement of the locking bolt and therefore of the driver, a smaller amount of friction of the slotted link rod in the slotted link groove and therefore a reduced application of force is permitted or—conversely—self-locking of the slotted link rod in the slotted link groove is prevented or at least reduced.

In an expedient development, said third curved portion is configured in its width and/or its positioning angle in such a manner that, despite the slotted actuating link not being moved, at least a movement distance (or: a shortened movement extent) of the driver that is shortened in comparison to an actuating stroke of the driver is permitted. The above-described neutral position of the driver or of the locking bolt can therefore be formed in this case by a region. A shortened movement distance is understood here as meaning in particular (at least for a telescopic boom of a crane of a medium load class with a maximum carrying load of approximately 80 to 150 tons) a movement extent of 15 to 20 mm (in the case of higher load classes, i.e., a higher maximum carrying load and an associated thicker wall of the telescopic boom, this movement extent is preferably correspondingly scaled, for example up to approximately 40 mm). In particular, this movement is permitted by a combination of shallow positioning angle and width of the curved portion since, in particular for the slotted link rod, the play along the push-out direction is thus increased. By means of this play, tolerance compensation is advantageously also permitted, in particular when the boom extension segment is moved into a bolting region of the outer boom segment.

In a further expedient embodiment, the locking device has a position sensor, preferably in the manner of an absolute value sensor, for detecting the position of the slotted actuating link. The position sensor comprises two proximity switches and a perforated encoding plate. In particular, the position sensor is configured to detect three positions of the slotted actuating link, in particular the neutral position and the correspondingly opposed end positions. The embodiment of the position sensor with two proximity switches and the encoding plate is a cost-effective and equally (mechanically and also electrically) robust implementation. In particular, the holes of the encoding plate are formed comparably to an encoding disk with a gray code for identifying the actuating position.

The telescopic boom according to the invention is configured and provided for use on a mobile crane and has—as described above—a number of boom segments and the above-described locking device. The telescopic boom preferably also has a telescoping drive, in particular a telescoping cylinder, which preferably bears the locking device. The telescopic boom therefore equally also has all of the features described in conjunction with the locking device and the advantages associated therewith.

In an expedient development, the telescopic boom also has a control device which is configured and provided to activate the actuator. For the embodiment in which the slotted actuating link is designed as a plate with slotted link grooves molded therein and the three slotted link portions for the slotted link groove assigned to the driver, the control device is also configured for activating the actuator to adjust the slotted actuating link into the neutral position during a telescoping operation, when an inner boom extension segment is moved into a bolting region of an outer boom extension segment. The bolting region is understood here and below as meaning in particular a region of, say, 10 cm in front of and optionally also behind a bolting eye (as seen in the outward telescoping direction) for receiving the locking bolt in the outer boom extension segment (or main segment). The slotted actuating link, prior to moving into the bolting region, is preferably positioned in such a manner that the driver and therefore also the locking bolt are arranged in the release position. The effect achieved by the above-described play of the driver and in particular also by the actuating spring which acts on the locking bolt is that the locking bolt rests on the bolting region and can slide in order, preferably under additional action of the actuating spring, to latch into the corresponding bolting eye.

In an optional variant, the above-described control device is part of the locking device itself.

The control device (also referred to as "controller") is preferably at least essentially formed by a microcontroller having a processor and a data memory in which the functionality for controlling the locking device, i.e., in particular the actuator, is implemented by programming in the form of operating software (Firmware). Alternatively, however, the control device can also be formed by a nonprogrammable electronic component, e.g. an ASIC, in which the functionality for control purposes is implemented using circuitry means. Furthermore, optionally in addition, a purely electrical activation capability is also provided by—preferably the already existing—hydraulic valves being activatable directly (i.e., without interconnected logic), preferably by means of an (in particular manually actuable) switch connected in a corresponding control line. This serves preferably as an emergency controller if the electronic controller fails and provided that there is still a hydraulic supply.

With the above and other objects in view there is also provided, in accordance with the invention, a mobile crane which includes the above-described telescopic boom and therefore also the locking device. The control device of the telescopic boom (or: of the locking device) is optionally connected into a master controller of the mobile crane.

Other features which are considered as characteristic for the invention are set forth in the appended claims.

Although the invention is illustrated and described herein as embodied in a locking device for a telescopic boom, a telescopic boom, and a mobile crane, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Parts that correspond with one another are identified with the same reference signs throughout the figures.

DETAILED DESCRIPTION OF THE INVENTION

Figure 1:
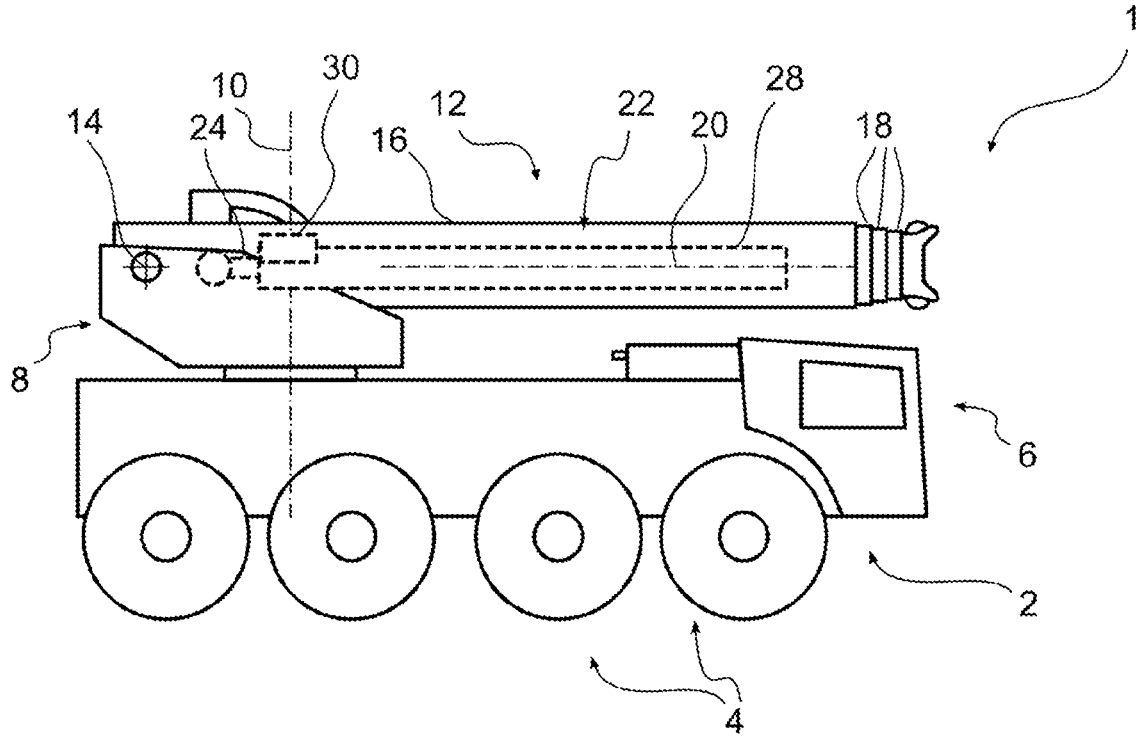
FIG. 1 is a schematic side view of a mobile crane with a telescopic boom and a telescoping device.

Referring now to the figures of the drawing in detail and first, in particular, to FIG. 1 thereof, there is shown a schematic illustration of a crane, specifically a mobile crane 1. The crane comprises an undercarriage 2 which, in turn, has a chassis with a plurality of driving axles carrying wheels 4, and a cockpit 6. The mobile crane 1 has a superstructure 8 which is rotatably coupled to the undercarriage 2 about a vertical axis 10. In addition, the mobile crane 1 comprises a crane boom (also: "telescopic boom", for short below: "boom 12") which forms part of the superstructure 8 and is coupled to a mounting of the superstructure 8 so as to be pivotable about a rocker axis 14 ("tiltably", i.e., adjustable in its inclination). The boom 12 is telescopic and, for this purpose, has a main segment 16 in which a plurality of further boom segments (also: "boom extension segments 18"), each reduced in size in their cross section, are accommodated displaceably along a longitudinal axis 20 of the crane boom 12. For the telescoping of the boom 12, the latter has a telescoping device, in the present exemplary embodiment formed by a hydraulically operated telescoping cylinder (for short: "telescope cylinder 22").

In an exemplary embodiment, not illustrated, the cockpit 6 of the undercarriage 2 is integrated in a driver's cab of the superstructure 8 such that the mobile crane 1 is controlled from the superstructure even in the driving mode.

The telescope cylinder 22 is arrested with its piston rod 24 in the base region of the main segment 16. The telescope cylinder 22 also bears a locking device 30 arranged at the rod-side end of its cylinder 28. Said locking device serves to grip one of the boom extension segments 18 during the telescoping of the boom 12 and to lock, i.e., arrest, said boom extension segment 18 in its target position to the closest outer boom extension segment 18 or optionally to the main segment 16.

Figure 2:
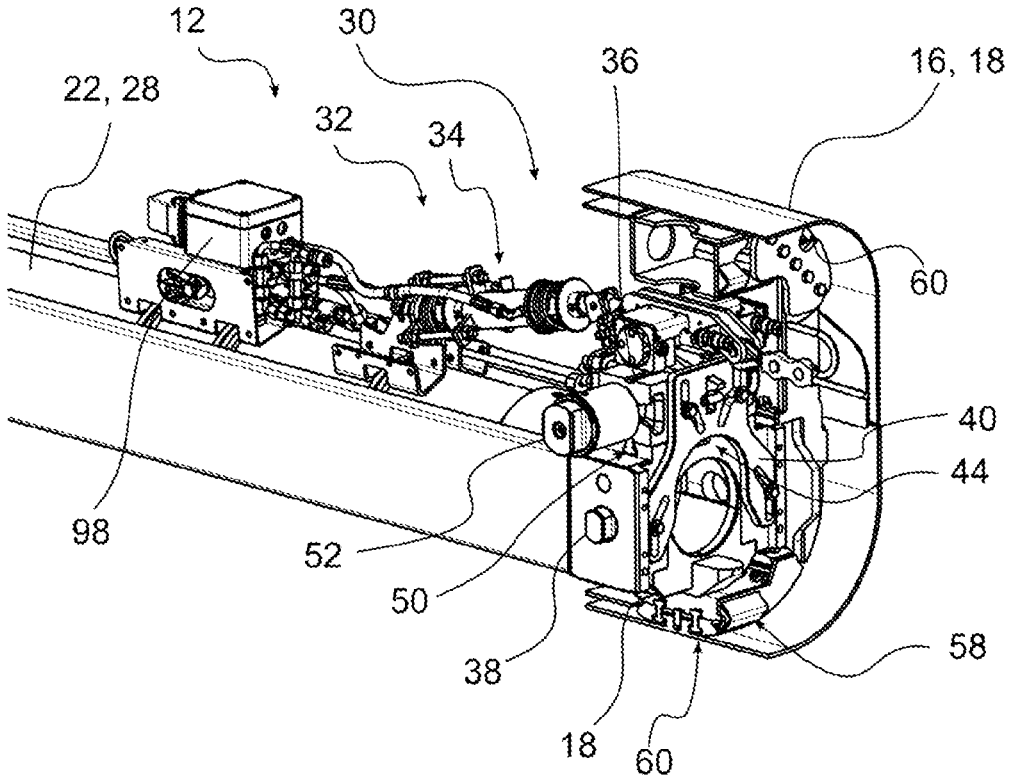
FIG. 2 is a perspective partial sectional illustration of the telescopic boom with a part of the telescoping device and a locking device.
Figure 4:
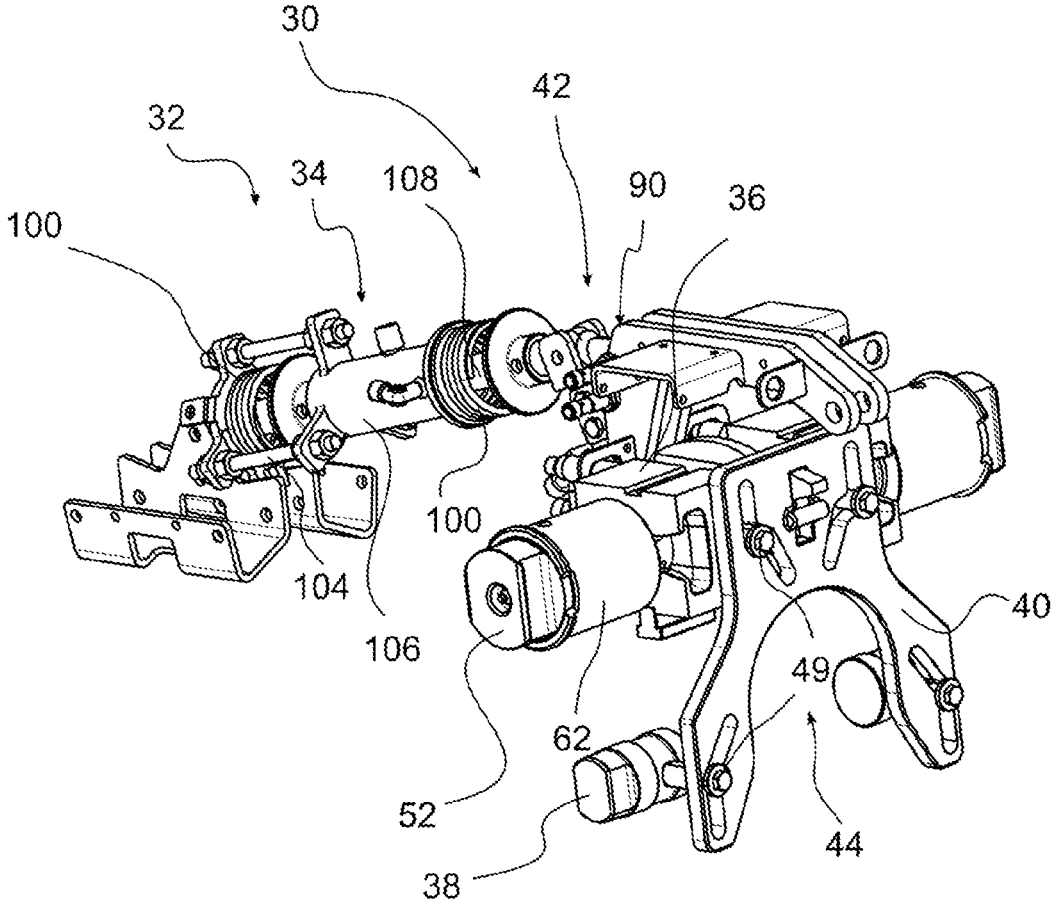
FIG. 4 is a perspective view of the locking device shown in FIG. 3.

As is apparent from FIG. 2, the locking device 30 has an actuator 32 which, in the present exemplary embodiment, comprises a double-acting hydraulic cylinder, specifically a modified plunger cylinder 34 (also referred to as "plunger piston cylinder"). In addition, the locking device 30 has two diametrically opposite drivers 36, which are oriented with a movement axis 35 perpendicularly to the longitudinal axis 20, and two identically arranged driver bolts 38 (also see FIGS. 4 and 6; for the sake of clarity, only the left driver bolt in the drawing is always numbered). For the transmission of the actuating force generated by the actuator 32 to the drivers 36 and the driver bolts 38 and therefore for the adjustment thereof, the locking device 30 also has a slotted actuating link 40. The latter is oriented with its movement plane radially with respect to the longitudinal axis 20 (which corresponds to a telescoping direction of the boom 12). Specifically, the movement direction of the slotted actuating link 40 runs in a tilting plane (i.e., from the bottom upward and vice versa in FIGS. 5 to 8) of the boom 12.

Figure 3:
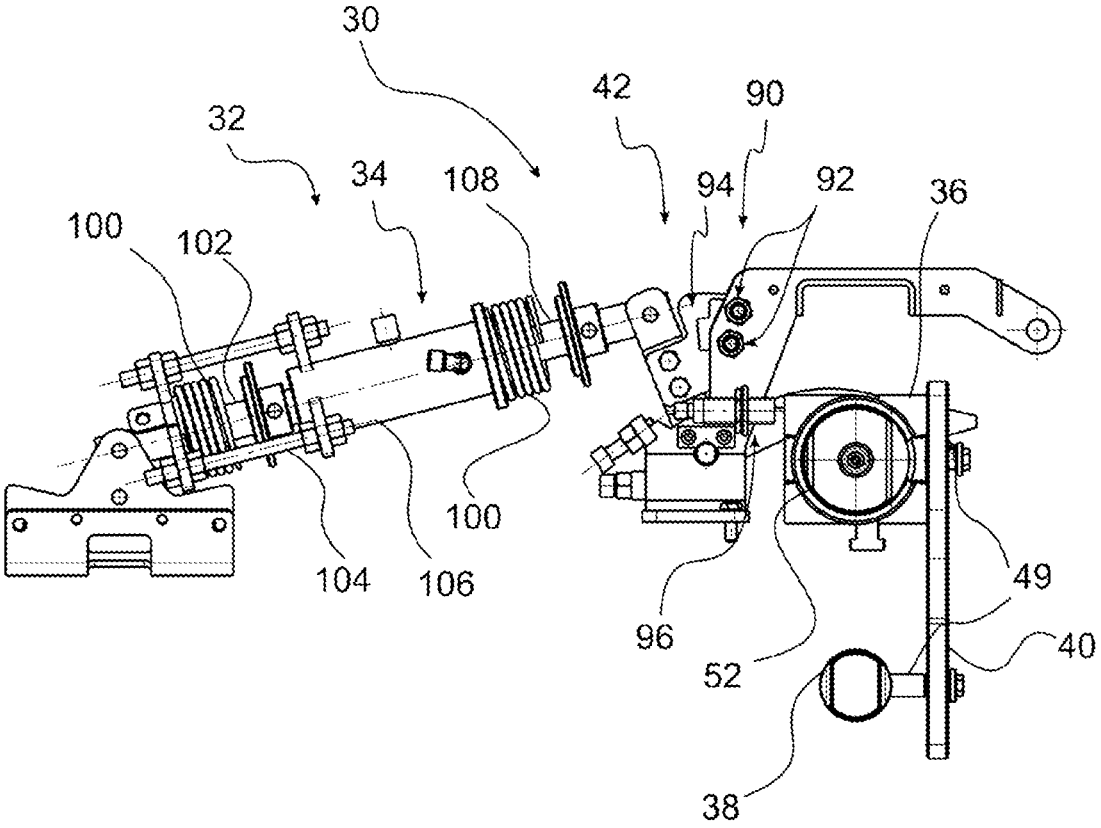
FIG. 3 is a schematic side view of the locking device separately.

In addition to the plunger cylinder 34, the actuator 32 has lever kinematics 42 serving to deflect the rectilinear movement generated by the plunger cylinder 34 to the slotted actuating link 40 by means of rotation (see FIG. 3).

The slotted actuating link 40 is formed by a roughly H-shaped or omega-shaped plate in order to keep a recess 44 for the piston rod 24 free. In each case a first slotted link groove 46 for the respective driver 36 and in each case a second slotted link groove 48 for the respective driver bolt 38 are introduced into said plate. Consequently, the slotted actuating link 40 in each case has two first and two second slotted link grooves 46 and 48, respectively. The drivers 36 and the driver bolts 38 are coupled in their respective slotted link groove 46 and 48, respectively, by means of a respective slotted link rod 49 for adjustment radially with respect to the longitudinal axis 20, specifically in each case in the direction of the associated longitudinal side of the boom 12. In addition, the drivers 36 and driver bolts 38 are guided in sliding rails 50 or sliding sleeves (not illustrated) along their respective movement axis 35.

The driver bolts 38 are configured and provided to couple the telescope cylinder 22 during a telescoping movement to the boom extension segment 18 to be adjusted. The driver bolts 38 are therefore assigned to the locking device 30. The drivers 36 serve to adjust a respective locking bolt 52 under the action of the actuating force in order to lock (or: "bolt") a boom extension segment 18 to the next outer boom extension section 18 or to the main segment 16. Since the boom extension segments 18, as is known, also have to remain in their telescoped position after the telescoping movement, the locking bolts 52 are assigned to the boom extension segments 18. In other words, each boom extension segment 18 has a pair of locking bolts 52.

The drivers 36 and also the slotted actuating link 40 are configured in such a manner that the driver 36 can be coupled reversibly to the respective locking bolt 52. For this purpose, the respective driver 36 is designed in the manner of a claw. Specifically, the respective driver 36 has a T groove 54. The respective locking bolt 52 has, at its inner end, a T head 56 corresponding to the T groove 54 (see FIGS. 4 and 6). For the telescoping of a boom extension segment 18, first of all the telescope cylinder 22 is adjusted in such a manner that the locking device 30 is arranged in the "base region" of the corresponding boom extension segment 18. The boom extension segment 18 has a portion there that is also referred to as "bearing bracket 58". Sliding elements 60, inter alia, are arranged on the outer side of said bearing bracket 58 and slide on the inner side of the next outer boom extension segment 18 or of the main segment 16. In addition, the bearing bracket 58 has bolting eyes (not illustrated) for receiving the driver cylinders 38, and also the locking bolts 52, which are guided in guide sleeves 62 (see FIGS. 4 and 5).

If the telescope cylinder 22 "moves" with the locking device 30 into the region of the bearing bracket 58, the drivers 36 slide with the T grooves 54 over the T heads 56 of the locking bolts 52 and therefore grip the latter. In this state, the locking device 30 can adjust the locking bolts 52, i.e., can release (also: "pull") or push them outward for locking the respective boom extension segment 18 along the movement axis 35. The locking bolts 52 are arranged on the bearing bracket 58 in such a manner that they are pressed under the action of an actuating spring, not illustrated specifically, into a locking position 64 in which they protrude on the outer side over the bearing bracket 58 (see FIGS. 6 and 7) and therefore can couple to a corresponding bolting eye (not illustrated) of the next outer boom extension segment 18 or of the main segment 16.

Figure 5:
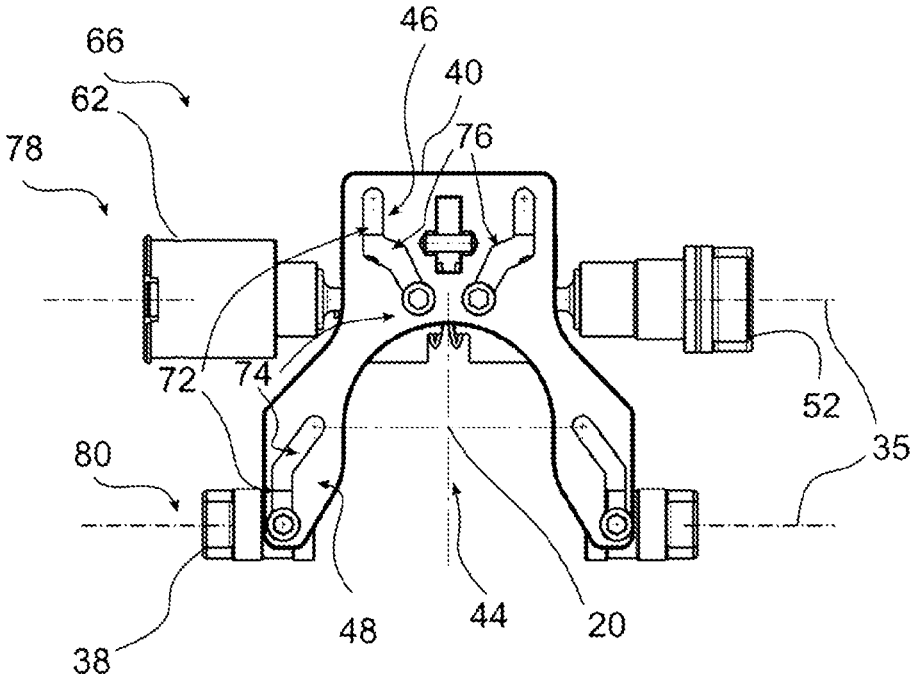
FIGS. 5-8 are schematic frontal views of the locking device in four different states.

The slotted actuating link 40 is, as is apparent from FIGS. 5 to 8, adjustable between three positions. An upwardly pulled end position, also referred to as tele-position 66, is illustrated in FIG. 5. A downwardly pushed end position, also referred to as securing position 68, is illustrated in FIG.

Figure 6:
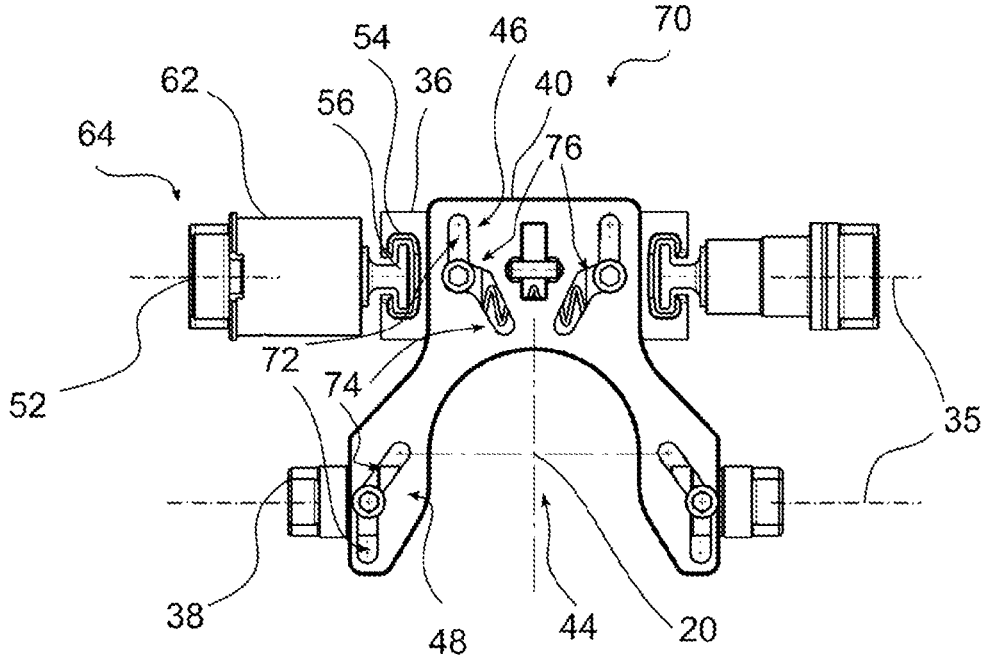
Figure 7:
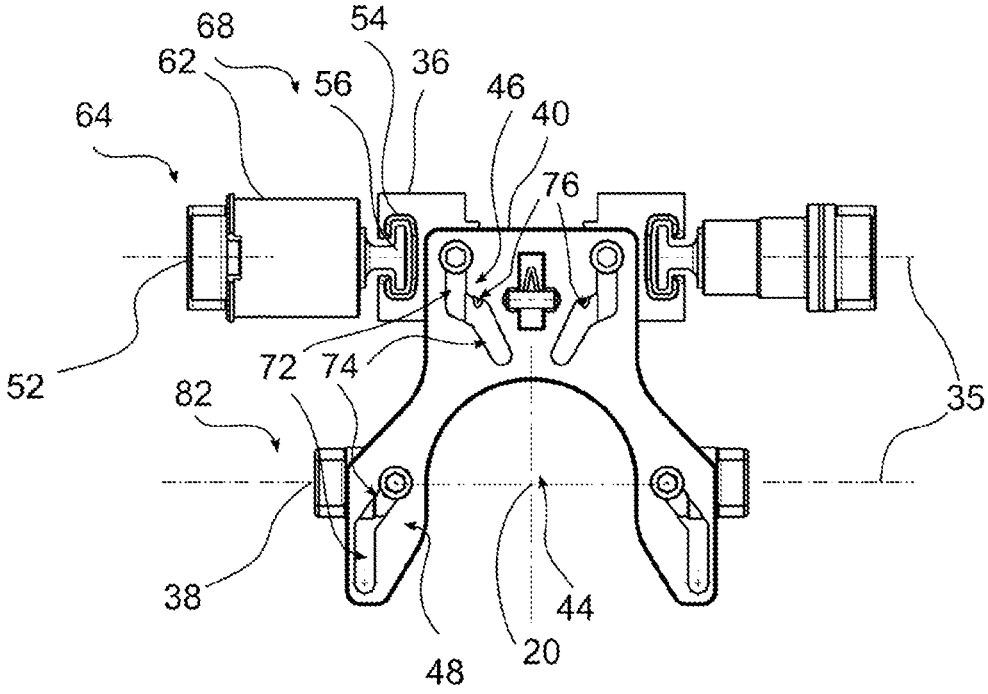

7. A neutral position 70 arranged between the tele-position 66 and the securing position 68 is illustrated in FIGS. 6 and 7.

The second slotted link grooves 48 have two rectilinear curved portions which are at an angle to one another, and therefore have a single angle. The first slotted link grooves 46 have three rectilinear curved portions which are angled in relation to one another, and therefore have a double angle. The respective end-side curved portions of the slotted link grooves 46 and 48 are referred to as securing portion 72 and retraction portion 74. The third "middle" curved portion of the first slotted link groove 46 is referred to as neutral portion 76. The securing portions 72 are oriented parallel to the direction of movement of the slotted actuating link 40, whereas the retraction portions 74 are positioned facing obliquely inward counter to the push-out direction of the drivers 36 and of the driver bolts 38. As is apparent from FIGS. 5 to 8, the securing portions 72 and the retraction portions 74 of the first and second slotted link grooves 46 and 48 are oriented in an opposed manner with respect to the direction of movement of the slotted actuating link 40.

As a result, a diametrically opposed movement or adjustment of the driver bolts and of the locking bolts 38 and 52, respectively, takes place. In the tele-position 66, the locking bolts 52 are retracted into a release position 78 in which they are not coupled to the outer boom extension segment 18 or main segment 16, i.e., the adjustment of the inner boom extension segment 18 is enabled. By contrast, the driver bolts 38 are pushed out into what is referred to as a carry-along position 80, in which they are coupled to the bearing bracket 58.

In the securing position 68 of the slotted actuating link 40 (see FIG. 7), the locking bolts 52, by contrast, are arranged in their locking position 64, whereas the driver bolts 38 are retracted into an empty running position 82. As a result, the telescope cylinder 22 can be moved without carrying along a boom extension segment 18, but with the boom extension segments 18 being secured because of the pushed-out locking bolts 52 (what is referred to as "empty running").

While the driver 36 is moved inward or outward along the associated retraction portion 74, the driver bolt 38 remains in its locked position, i.e., the carry-along position 80 (the same also applies conversely), since the securing portion 72 is oriented parallel to the direction of movement of the slotted actuating link 40.

Figure 8:
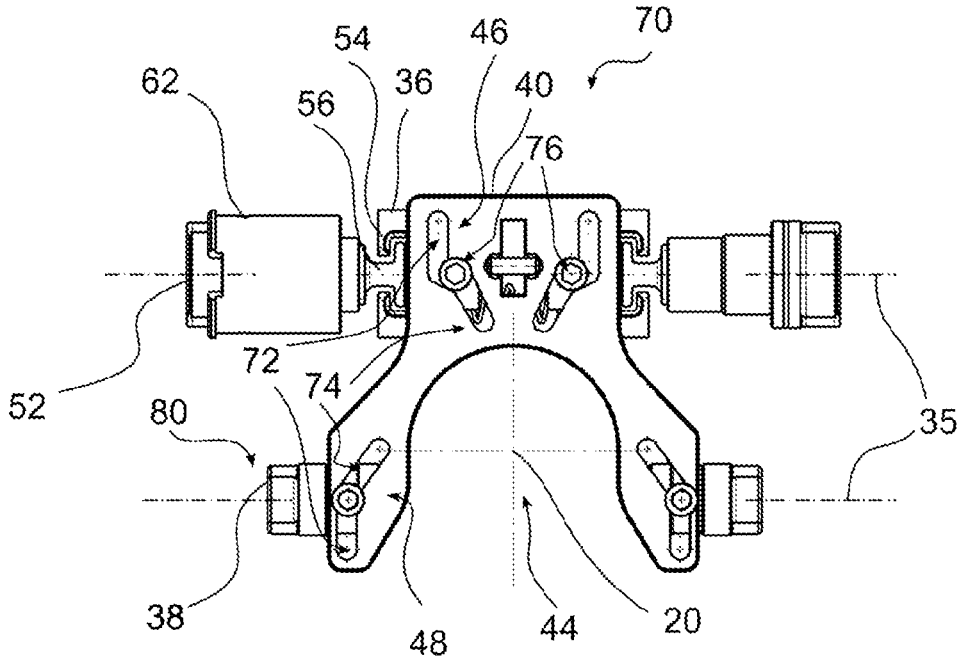

In the neutral position 70, the slotted actuating rods 49 of the drivers 36 are arranged in the region of the neutral portion 76. Said neutral portion is positioned more shallowly, i.e., at a smaller angle than the retraction portion 74 counter to the push-out direction, i.e., counter to the movement axis 35. This results in a smaller amount of friction when the locking bolt 52 is adjusted manually from the outside in the direction of its release position 78. The neutral portion 76 therefore permits emergency unlocking of the locking bolts 52. In addition, because of the position and the width of the first slotted link groove 46, the slotted link rod 49 has a comparatively greater amount of play along the movement axis 35 of the driver 36 in the region of the neutral portion 76. As a result, tolerance compensation in the region of the bearing bracket 58 and also the manual pushing in of the locking bolt 52 are simplified. A position of the locking bolts 52 during an emergency unlocking is illustrated in FIG. 8.

In order to be able to detect the position of the slotted actuating link 40, the locking device 30 has a position sensor 90. The latter is arranged in the region of the lever kinematics 42 and configured for detecting a rotational position. For this purpose, the position sensor 90 has two proximity switches 92 and an encoding disk 94 made from sheet metal with apertures as coding fields. By means of the proximity switches 92, the position of the encoding disk 94 is identified as to whether a coding field or a sheet metal wall lies opposite the corresponding proximity switch 92. This embodiment of the position sensor 90 is, as is known, robust against soiling by lubricants or hydraulic media and, in particular because of the large size of the elements selected, also against vibration.

In order in addition also to be able to interrogate the actual position of the driver 36, the latter is likewise assigned a proximity switch 96. The latter serves to detect whether the driver 36 and therefore the locking bolt 52 are arranged in the locking position 64 and therefore the boom extension segment 18 is secured. This also permits a conclusion to be drawn as to whether the corresponding boom extension segment 18 is arranged in its telescopic position as intended. This is because, during the telescoping of the boom extension segment 18, a control device 98 activates the locking device 30 in such a manner that the slotted actuating link 40, on moving into the bolting region of the outer boom extension segment 18 or of the main segment 16, is arranged in the neutral position 70. As a result, the drivers 36 and the locking bolts 52 already bear on the inner side against the outer bolting region because of the play in the neutral portion 76 and because of the spring loading outward. The locking bolt 52 can therefore "feel" its associated bolting eye when the latter is "passed over".

The plunger cylinder 34, as can be seen in FIG. 3, is spring-loaded by means of two restoring springs 100 in such a manner that, in the unpressurized state, it is returned into a neutral position and, in the process, adjusts the slotted actuating link 40 into its neutral position 70. For this purpose, a restoring spring 100 is coupled to a piston rod 102 and a "spring cage 104" such that the piston rod 102 is pushed back into the cylinder 106. The other restoring spring 100 is arranged between the cylinder 106 and the other piston rod 108 in such a manner that, in the unpressurized situation, said piston rod 108 is pulled out of the cylinder 106. By setting the length of the spring cage 104, the length of the plunger cylinder 34 in the unpressurized situation can be specified.

It should be understood that the subject matter of the invention is not restricted to the above-described exemplary embodiment. Rather, further embodiments of the invention can be derived by those of skill in the pertinent art from the above description.

The following is a summary list of reference numerals and the corresponding structure used in the above description of the invention:

1 Mobile crane
2 Undercarriage
4 Wheel
6 Cockpit
8 Superstructure
10 Vertical axis
12 Boom
14 Rocker axis
16 Main segment
18 Boom extension segment
20 Longitudinal axis
22 Telescope cylinder
24 Piston rod
28 Cylinder
30 Locking device
32 Actuator

34 Plunger cylinder
35 Movement axis
36 Driver
38 Driver bolt
40 Slotted actuating link
42 Lever kinematics
44 Recess
46 Slotted link groove
48 Slotted link groove
49 Slotted link rod
50 Sliding rail
52 Locking bolt
54 T groove
56 T head
58 Bearing bolt
60 Sliding element
62 Guide sleeve
64 Locking position
66 Tele-position, telescoped position
68 Securing position
70 Neutral position
71 Securing portion
74 Retraction portion
76 Neutral portion
78 Release position
80 Carry-along position
82 Empty running position
90 Position sensor
92 Proximity switch
94 Encoding disk
96 Proximity switch
100 Restoring spring
102 Piston rod
104 Spring cage
106 Cylinder
108 Piston rod

The invention claimed is:

1. A locking device for a telescopic boom, the locking device comprising:

an actuator for generating an actuating force;

at least one driver configured to be reversibly coupled, during a telescoping movement of the telescopic boom, to a locking bolt that is secured at a boom extension segment of the telescopic boom, and to be moved by the actuating force for adjusting the locking bolt between a locking position and a release position;

at least one driver bolt configured to be reversibly moved by the actuating force between a carry-along position, gripping an inner boom extension segment, and an empty running position in which no boom extension segment is gripped; and a slotted actuating link configured for a joint movement of the locking bolt and said at least one driver bolt, said slotted actuating link, in an installation state as intended, defining a movement plane perpendicular to a telescoping direction of the telescopic boom.

2. The locking device according to claim 1, wherein said slotted actuating link is a plate formed with a first slotted link groove for guiding said at least one driver and with a second slotted link groove for guiding said at least one driver bolt, and wherein said driver and said driver bolt are coupled in said slotted link grooves in terms of force transmission.

3. The locking device according to claim 2, wherein each of said first and second slotted link grooves has at least two curved portions, wherein a retraction portion of said curved portions is positioned at an angle counter to a push-out direction of at least one of the locking bolt or said driver bolt, and wherein a securing portion of the curved portions is arranged in each case in the push-out direction of the locking bolt or said driver bolt on an outer side with respect to said retraction portion and is oriented perpendicularly to the push-out direction.

4. The locking device according to claim 3, wherein said first slotted link groove has a third curved portion between said retraction portion and said securing portion, and said third curved portion is assigned to the neutral position and, in comparison with said retraction portion, is positioned more shallowly counter to the push-out direction.

5. The locking device according to claim 4, wherein said third curved portion has a width and/or a positioning angle configured such that, despite said slotted actuating link being unmoved, at least a movement distance of said driver that is shortened in comparison with an actuating stroke of said driver is permitted.

6. The locking device according to claim 1, wherein said slotted actuating link is configured to have said driver bolt arranged in an empty running position thereof when said driver is arranged in a position assigned to the locking position of the locking bolt.

7. The locking device according to claim 1, wherein said slotted actuating link has a neutral position in which said driver is arranged in a neutral position between the locking position assigned to the locking bolt and the release position.

8. The locking device according to claim 7, wherein said slotted actuating link, in particular the first slotted link groove, is configured such that, in a neutral position, a restoring force applied externally to said driver leads to an adjustment of said driver.

9. The locking device according to claim 7, wherein said slotted actuating link is formed with a first slotted link groove configured such that, in a neutral position, a restoring force applied externally to said driver leads to an adjustment of said driver.

10. The locking device according to claim 7, wherein said slotted actuating link is spring-loaded directly or indirectly in a direction of the neutral position.

11. The locking device according to claim 1, further comprising a position sensor for detecting a position of said slotted actuating link, said position sensor including two proximity switches and a perforated encoding plate.

12. The locking device according to claim 11, wherein said slotted actuating link is spring-loaded directly or indirectly in a direction of the neutral position.

13. The locking device according to claim 1, configured for a telescopic boom of a mobile crane.

14. A telescopic boom for a mobile crane, the telescopic boom comprising: a plurality of telescoping boom segments and a locking device according to claim 1.

15. The telescopic boom according to claim 14, wherein:

said slotted actuating link of said locking device is a plate formed with a first slotted link groove for guiding said driver and with a second slotted link groove for guiding said driver bolt, and wherein said driver and said driver bolt are coupled in said slotted link grooves in terms of force transmission, each of said first and second slotted link grooves has at least two curved portions, wherein a retraction portion of said curved portions is positioned at an angle counter to a push-out direction of the locking bolt or said driver bolt, and wherein a securing portion of the curved portions is arranged in each case in the push-out direction of the locking bolt or said driver bolt on an outer side with respect to said retraction portion and is oriented perpendicularly to the push-out direction, and wherein said first slotted link groove has a third curved portion between said retraction portion and said securing portion, and said third curved portion is assigned to the neutral position and, in comparison with said retraction portion, is positioned more shallowly counter to the push-out direction; and the telescopic boom further comprises:

a control device configured to activate an actuator for adjusting said slotted actuating link into the neutral position during a telescoping operation, when an inner boom extension segment is moved into a bolting region of an outer boom extension segment.

16. A mobile crane, comprising the telescopic boom formed with a plurality of telescoping boom segments and a locking device according to claim 1.

* * * * *